United States Patent [19]

Lehmacher

[11] Patent Number: 4,595,389

[45] Date of Patent: Jun. 17, 1986

[54] STACK OF DETACHABLY-CONNECTED BAGS WITH PUNCH-OUT HANDLE-GRIP OPENINGS AND PROCESS FOR MAKING SAME

[75] Inventor: Hans Lehmacher, Niederkassel-Mondorf, Fed. Rep. of Germany

[73] Assignee: Lemo M. Lehmacher & Sohn GmbH Maschinenfabrik, Niederkassel-Mondorf, Fed. Rep. of Germany

[21] Appl. No.: 735,958

[22] Filed: May 20, 1985

[30] Foreign Application Priority Data

Jun. 2, 1984 [DE] Fed. Rep. of Germany ..... 3420620

[51] Int. Cl.[4] ..... B21B 1/14; B65D 33/10; B65H 3/58; B32B 31/00

[52] U.S. Cl. ..... 493/227; 53/390; 156/252; 206/806; 206/526; 221/26; 383/9; 383/10; 383/37

[58] Field of Search ..... 493/227; 53/390, 396; 156/250, 252, 290; 206/526, 554, 806, 813, 493; 221/26; 383/9, 10, 37; 248/95, 98, 100

[56] References Cited

U.S. PATENT DOCUMENTS

| | | | |
|---|---|---|---|
| 3,777,930 | 12/1973 | Ericson et al. | 248/100 |
| 3,967,775 | 7/1976 | Kramming | 206/806 |
| 4,519,504 | 5/1985 | Nausedas | 206/526 |

FOREIGN PATENT DOCUMENTS

| | | |
|---|---|---|
| 2204638 | 7/1974 | Fed. Rep. of Germany . |
| 2228767 | 2/1983 | Fed. Rep. of Germany . |

*Primary Examiner*—Francis S. Husar
*Assistant Examiner*—Jorji M. Griffin
*Attorney, Agent, or Firm*—Karl F. Ross; Herbert Dubno

[57] ABSTRACT

A stack of detachably-connected, individually carryable bags of a plastic material, preferably plastic foil. Each bag has a front wall, a rear wall and an upper bag opening. The bag walls of each bag are provided with centrally positioned punch-out pieces positioned opposite each other adjacent the upper bag opening. The punch-out pieces may be removed by hand to form handle grips. The punch-out pieces of each of the bags in the ones of the bag walls that are on one and the same side of all of the bags in the stack are removed. Uniting the individual bags into a single stack without additional structural members is possible, when the punch-out pieces remaining in the stack and constructed as oblong perforations are interlocked with each other.

14 Claims, 4 Drawing Figures

STACK OF DETACHABLY-CONNECTED BAGS WITH PUNCH-OUT HANDLE-GRIP OPENINGS AND PROCESS FOR MAKING SAME

FIELD OF THE INVENTION

My present invention relates to a stack or pad of bags and, more particularly, to a stack of detachably-connected, individually carryable and fillable bags of plastic (synthetic resin) foil, and to a process for their manufacture.

BACKGROUND OF THE INVENTION

Known stacks or pads of bags particularly plastic bags, comprise a plurality of plastic foil bags each of which can have bag walls provided with a centrally positioned punched opening forming hand grips adjacent an upper bag opening.

A process for making such stacks of plastic bags feeds plastic foil from a roll to a cutting machine which cuts and seals the foil into individual bag segments with a front and rear side. These individual bag segments may be then punched, stacked and welded into pads.

One uses pads of the above-described kind in conjunction with holders in order to make possible holding a bag for filling and the subsequent removal of the bag from the stack with a single hand.

In the known bags of the prior art German patent application (DE-OS No. 22 28 767) the punch-out pieces from which the handle grip openings are removed from both bag walls, but the handle grip openings associated with one bag wall of each bag are made somewhat smaller than the other handle grip openings.

The bags are united into a single stack, when they are pushed onto a tubular or casing-like hanger, whose size is between that of the two handle grip openings so that one wall can be drawn away from the stacks while the other bag wall can be held fixed on the hanger and after filling the bag can be removed.

It is, however, a disadvantage that a separate structural component is required for stack construction, that component being in this case the tubular or casing-like hanger.

In the manufacture of shirt bags in stacks it is of course already known (DE-AS No. 22 04 638), to provide the individual bags with oblong pieces defined by perforations constituting punch-outs and to weld the bags lying next to each other with each other in a single operation at the punch-outs. This technique has not been applied heretofore to the problem of the stacks of open-top bags or the bags of the kind of the present invention described above because shirt bags are formed entirely differently from the bags my invention is applied to.

OBJECTS OF THE INVENTION

The principal object of my invention is to provide an improved stack of bags of the above-described kind attached to each other without additional structural components such as hangers, staples, and the like.

It is another object of my invention to provide an improved pad of bags, particularly an improved stack of detachably-connected individually carryable plastic bags, and an improved process for making them.

It is yet another object of my invention to provide an improved stack of interconnected plastic bags having a front bag wall, a rear bag wall, and an upper bag opening which are individually detachable and carryable for filling, but are formed attached to each other in a stack without additional structural components such as hangers, staples, and the like.

It is another object of my invention to provide an improved process for making a stack of individually carryable, detachably-connected plastic bags which does not require supplying an additional structural component for holding the stack of bags together.

SUMMARY OF THE INVENTION

These objects and others which will become apparent hereinafter are attained in accordance with our invention in a stack of detachably-connected bags comprising preferably a plurality of plastic bags each having bag walls and an upper bag opening, each bag wall being provided with a centrally positioned punch-out piece whose removal results in a handle grip adjacent the upper bag opening, wherein the punch-out piece of each of the bags in the ones of the bag walls that are one and the same side of all of the bags in the stack is removed. The bags used in my invention are preferably of a plastic material, particularly plastic foil.

According to an essential feature of the invention the punch-out pieces of the other ones of the bag walls are not removed from the bags and are left in the stack of the bags and are interlocked with each other, i.e. are fusion welded preferably by point heat seals.

Furthermore another feature of my invention is that the punch-out pieces not removed from the stack of bags are attached detachably with the bag wall associated therewith by at least two lower tear bridges and at least one upper tear bridge. Also the bags are connected with each other by interlocking the punch-out pieces of the bag walls not removed from the stack of the bags by at least one interlock point or heat seal. Preferably two interlock points are employed.

Additionally, the punch-out pieces are provided with at least one-hang-up punch-out hole for suspending or hanging the stack of bags for temporary storage. Two hang-up punch-out holes are preferred.

An improved process for making stacks of plastic bags of the foregoing kind correspondingly includes making the punch-out pieces which result in handle grips as oblong perforations in the bag walls, and connecting the bags with each other by interlocking by heat sealing the punch-out pieces left in the stack of bags, when one punch-out piece is removed from one side wall of each bag, the latter side wall being always on the same side of the stack.

BRIEF DESCRIPTION OF THE DRAWING

The above and other objects, features and advantages of my invention will become more readily apparent from the following description, reference being made to the accompanying drawing in which.

SPECIFIC DESCRIPTION

Figure 1:
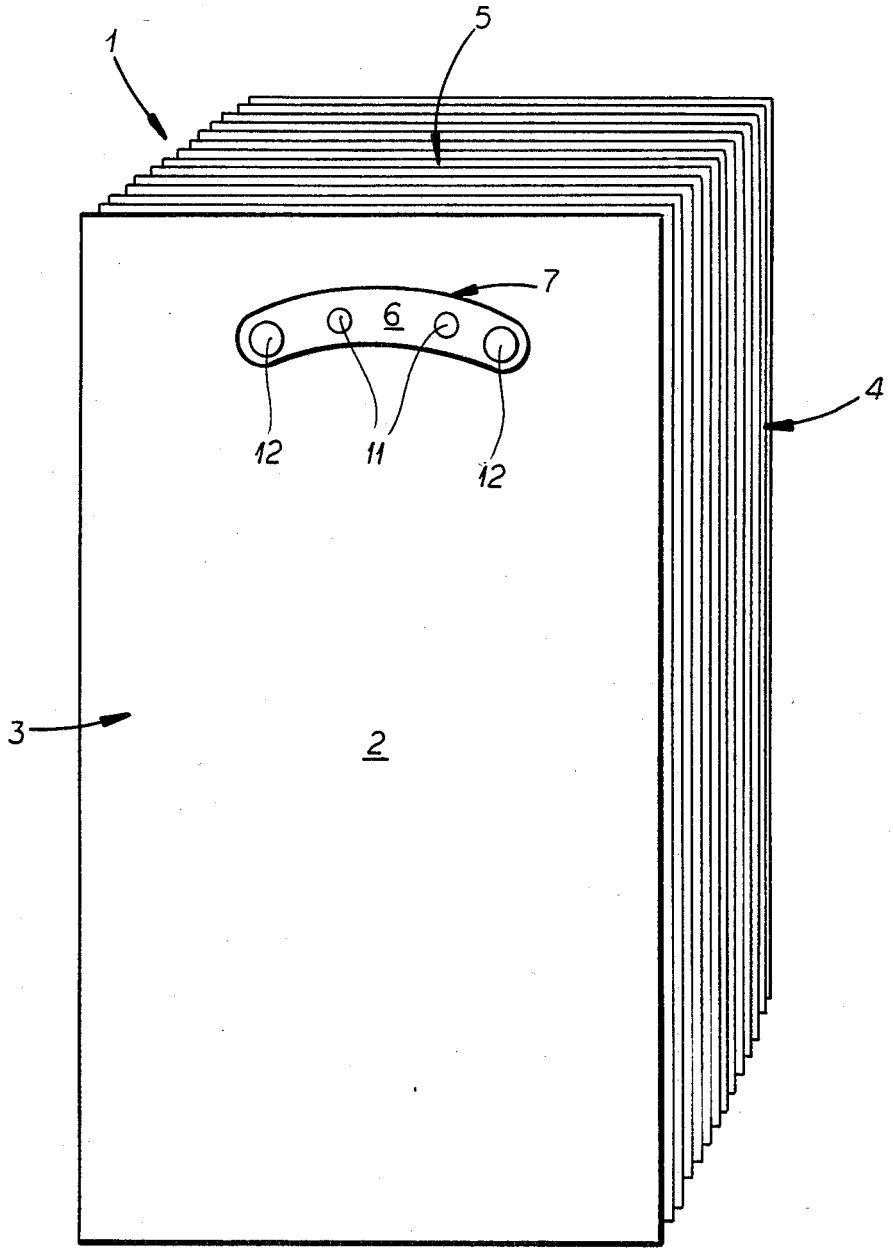
FIG. 1 is a perspective view of a stack of detachably-connected, individually carryable bags according to my invention.

The stack 1 shown in FIG. 1 comprises a plurality of detachably-connected, individually carryable bags 2 attached to each other and made of plastic material, preferably plastic foil, e.g. a polyethylene. Each bag 2 has a front wall 3, a rear wall 4 and an upper bag opening 5. Both bag walls, front wall 3 and rear wall 4, are provided with a centrally positioned punch-out piece 6 which can be removed to give handle grips 7 and 8, positioned opposite each other adjacent the upper bag opening 5. Otherwise the individual bag structure is arbitrarily variable within the scope of this invention.

In this embodiment handle grip opening 7 arrises by removal of the punch-out piece 6 in front wall 3, while the punch-out piece 6 associated with handle grip opening 8 is retained in the completed stack 1.

Figure 2:
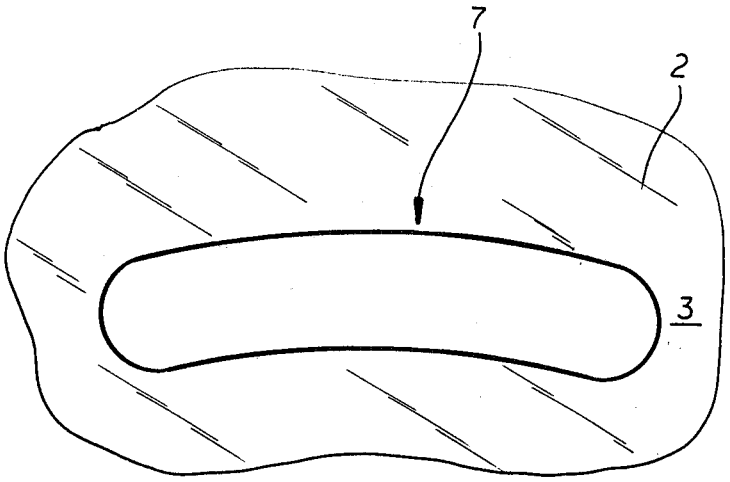
FIG. 2 is a planar elevational view of the front wall of an individual bag shown in FIG. 1.

As one can see from FIG. 2, the handle grip openings 7 in the front walls 3 of the individual bags 2 are punched out so that the corresponding punch-out pieces 6 are removed and/or are no longer attached to the front walls 3 of bags 2 in the stack 1 according to my invention.

Figure 3:
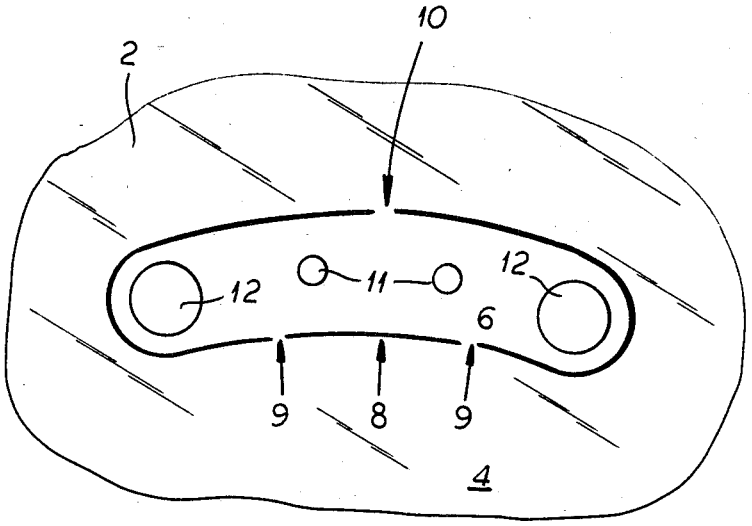
FIG. 3 is a planar elevational view of the rear wall of an individual bag shown in FIG. 1.
Figure 4:
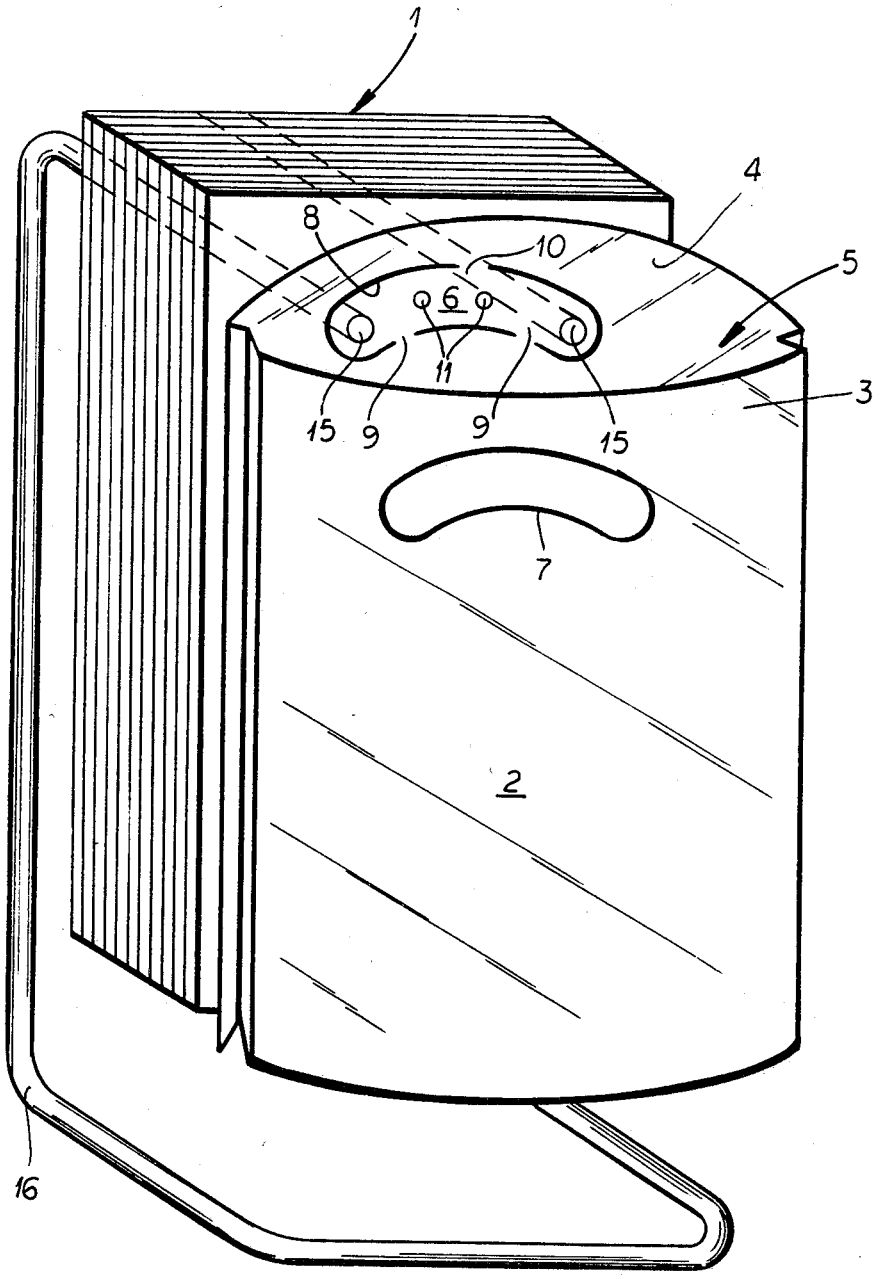
FIG. 4 shows a stack in perspective wherein one bag to be filled is still retained on the stack by its punch-out handle portion.

The punch-out pieces 6 of the handle grip openings 8 are constructed as elongated perforated punch-outs, so that these punch-out pieces 6 are retained in the completed stack 1 of bags 2. They are still attached with the rear walls 4 by two lower tear bridges 9 and one upper tear bridge 10. Also by these removable punch-out pieces 6 the individual bags 2 are connected with each other, and of course as seen in FIGS. 1 and 3 by the two interlock or weld points 11. Adjacent the interlock points 11 two hang-up punch-outs 12 are provided in the removable punch-out pieces 6 of handle grips 8 by which the stack 1 can be hung on a corresponding holding device as shown at 15 in FIG. 4 where the holder forms part of a stand 16. As can be seen from this FIGURE, the front wall 3 of the bag can be drawn out to open the mouth 5 and permit filling. The bag is retained by the tearaway piece 6 of the handle opening 8. When the bag is filled, the wall 4 is pulled away from the stack, leaving the perforated piece 6 behind and unblocking the opening 8.

I claim:

1. A stack of plastic foil bags having two bag walls and an upper bag opening, each of said bag walls being provided with a respective centrally positioned punch-out piece whose removal results in a handle grip opening positioned adjacent said upper bag opening of said bag, the punch-out piece of one of said bag walls of each bag being removed, the punch-out piece of each other wall of said bag remaining in the respective handle grip opening, the remaining punch-out pieces being bonded together to retain said bags in said stack.

2. The stack according to claim 1 wherein said remaining punch-out pieces are attached to the respective bag walls by at least two lower tear bridges and at least one upper tear bridge.

3. The stack according to claim 1 wherein said remaining punch-out pieces are interlocked with each other by at least one interlock point.

4. The stack according to claim 3 wherein said bags are interlocked by two interlock points.

5. The stack according to claim 1 wherein said punch-out pieces are provided with at least one hang-up punch-out.

6. The stack according to claim 5 wherein said remaining punch-out pieces are each provided with two hang-up punch-outs.

7. In a process for making a stack of bags each having bag walls and an upper bag opening, each of said bag walls of said bags being provided with a centrally positioned punch-out piece whose removal results in a handle grip positioned adjacent said upper bag opening, wherein said punch-out piece of each of said bags in the ones of said bag walls that are on one and the same side of all of said bags in said stack are removed, and said punch-out pieces not removed from said bags are left in said stack and are interlocked with each other, the improvement comprising making an oblong perforation defining said punch-out pieces which result in said handle grips in said bag walls, and connecting said bags with each other by interlocking said punch-out pieces remaining in said stack of said bags.

8. In a stack of bags, each of said bags having bag walls and an upper bag opening, said bag walls being provided with centrally positioned punch-out pieces positioned opposite each other whose removal results in a handle grip positioned adjacent a bag opening of said bag, wherein said punch-out pieces of each of said bags in the ones of said bag walls that are on one and the same side of all of said bags in said stack are removed, the improvement wherein said punch-out pieces of each of said bags of the other ones of said bag walls not removed from said bags are left in said stack of said bags and are interlocked with each other.

9. The improvement according to claim 8 wherein said bags of said stack are made of a plastic material.

10. The improvement according to claim 8 wherein said punch-out pieces not removed from said stack of said bags are attached with said bag walls associated therewith by at least two lower tear bridges and at least one upper tear bridge.

11. The improvement according to claim 8 wherein said punch-out pieces of said bag walls not removed from said stack of said bags are interlocked with each other by at least one interlock point.

12. The improvement according to claim 11 wherein said bags are interlocked by two of said interlock points.

13. The improvement according to claim 8 wherein said punch-out pieces are provided with at least one hang-up punch-out.

14. The improvement according to claim 13 wherein said punch-out pieces are provided with two of said hang-up punch-outs.

* * * * *